US007549465B2

(12) United States Patent
Gong et al.

(10) Patent No.: US 7,549,465 B2
(45) Date of Patent: Jun. 23, 2009

(54) HEAT EXCHANGERS BASED ON NON-CIRCULAR TUBES WITH TUBE-ENDPLATE INTERFACE FOR JOINING TUBES OF DISPARATE CROSS-SECTIONS

(75) Inventors: Ying Gong, Collierville, TN (US); Steven Falko Wayne, Collierville, TN (US)

(73) Assignee: Lennox International Inc., Richardson, TX (US)

( * ) Notice: Subject to any disclaimer, the term of this patent is extended or adjusted under 35 U.S.C. 154(b) by 222 days.

(21) Appl. No.: 11/380,119

(22) Filed: Apr. 25, 2006

(65) Prior Publication Data

US 2007/0246206 A1 Oct. 25, 2007

(51) Int. Cl.

| | |
|---|---|
| ***F28F 9/02*** | (2006.01) |
| ***F28F 9/04*** | (2006.01) |
| ***F28D 1/00*** | (2006.01) |
| ***F28D 7/06*** | (2006.01) |

(52) U.S. Cl. ..... 165/173; 165/150; 165/175; 165/176; 165/178

(58) Field of Classification Search ..... 165/173, 165/150, 176, 178, 175
See application file for complete search history.

(56) References Cited

U.S. PATENT DOCUMENTS

| | | | | |
|---|---|---|---|---|
| 1,840,573 | A * | 1/1932 | Feldmeier | 165/70 |
| 1,940,963 | A * | 12/1933 | McIntyre | 165/149 |
| 1,958,226 | A * | 5/1934 | Askin | 165/150 |
| 2,021,117 | A * | 11/1935 | Lucke | 165/157 |
| 2,064,036 | A * | 12/1936 | Sandberg | 29/890.07 |

(Continued)

FOREIGN PATENT DOCUMENTS

| | | |
|---|---|---|
| DE | 3423746 C2 | 1/1986 |

(Continued)

OTHER PUBLICATIONS

Kays, W.M., et al., Compact Heat Exchangers, 1984, pp. 34-39, Krieger Publishing Company, Malabar, Florida.

(Continued)

*Primary Examiner*—Cheryl J Tyler
*Assistant Examiner*—Brandon M Rosati
(74) *Attorney, Agent, or Firm*—Brooks Kushman P.C.

(57) ABSTRACT

A heat exchanger (10) having at least one inlet tube (12) that ducts a heat exchange fluid (14). At least some of the inlet tubes (12) are characterized by a first cross-sectional profile (16). A core (18) is in fluid communication with the at least one inlet tube (12). The core (18) has one or more rows of core tubes that also duct the fluid. At least some of the core tubes (20) are characterized by a second cross-sectional profile (22). The first cross-sectional profile (16) is different from the second cross-sectional profile (22). A first endplate assembly (26) is positioned between the at least one inlet tube (12) and the core (18). The first endplate assembly (26) has a first section (28) that defines an inlet orifice (30) that is sized to sealingly engage the first cross-sectional profile (16). A second section (32) defines an outlet orifice (34) that is sized to sealingly engage the second cross-sectional profile (22). The first and second sections (28, 32) cooperate to provide a sealing engagement therebetween.

16 Claims, 14 Drawing Sheets

U.S. PATENT DOCUMENTS

| | | | | | |
|---|---|---|---|---|---|
| 2,187,555 | A | * | 1/1940 | Flindt | 165/70 |
| 2,733,899 | A | * | 2/1956 | Lehmann | 165/150 |
| 2,991,978 | A | * | 7/1961 | Jones | 165/111 |
| 3,262,497 | A | * | 7/1966 | Worthen et al. | 165/176 |
| 3,897,821 | A | * | 8/1975 | Babunovic et al. | 165/175 |
| 4,168,744 | A | | 9/1979 | Knulle et al. | |
| 4,206,806 | A | * | 6/1980 | Togashi | 165/82 |
| 4,766,953 | A | | 8/1988 | Grieb et al. | |
| 5,123,482 | A | | 6/1992 | Abraham | |
| 5,348,082 | A | | 9/1994 | Velluet et al. | |
| 5,425,414 | A | | 6/1995 | Bradley, Jr. et al. | |
| 5,538,079 | A | | 7/1996 | Pawlick | |
| 5,604,982 | A | | 2/1997 | Kent et al. | |
| 5,901,784 | A | | 5/1999 | Potier | |
| 6,003,592 | A | | 12/1999 | Yamamoto et al. | |
| 6,021,846 | A | | 2/2000 | Sasaki et al. | |
| 6,044,554 | A | | 4/2000 | Potier | |
| 6,073,686 | A | * | 6/2000 | Park et al. | 165/144 |
| 6,378,204 | B1 | | 4/2002 | Kim et al. | |
| 7,156,162 | B2 | * | 1/2007 | Manaka | 165/140 |

FOREIGN PATENT DOCUMENTS

| | | | |
|---|---|---|---|
| DE | 3538492 | A1 | 5/1986 |
| DE | 4109127 | A1 | 9/1992 |
| EP | 0272766 | B1 | 6/1988 |

OTHER PUBLICATIONS

Guidance On The New EC Regulation No. 2037/2000 On Substances That Deplete The Ozone Layer leaflet, Oct. 2000, pp. 1-12, Department of Trade and Industry, www.dti.gov.uk/access/ozone.htm.

* cited by examiner

| | Process Step | Goals | Example |
|---|---|---|---|
| Ⓐ | Analyze a customer order for new heat exchanger to cool a house. | Identify house area, External static pressure (ESP), and Air circulation rate. | A = 750 $ft^2$<br>ESP = 0.2"<br>6 circulations per hour |
| Ⓑ | Define capacity of heat exchanger needed. | Cool a house efficiently. | 1.5 Ton = 18,000 Btu/hr |
| Ⓒ | Set up a limit for the pressure drop for air flowing through the heat exchanger. | Make sure that fan and motor assembly is capable of delivering conditioned air to every corner of the house. | 1. 600 CFM @ 400 CFM/Ton volumetric flow<br>2. 0.3" total static pressure (TSP)<br>3. TSP-ESP = 0.3-0.2 = 0.1" is the maximum allowable airside pressure drop through the heat exchanger |
| Ⓓ | Determine refrigerant | Configure heat exchanger structure. | R-22, a typical working fluid for household air conditioning systems |
| Ⓔ | Determine refrigerant charge amount. | Make sure to effectively use heat transfer area. | 6 lbs |
| Ⓕ | Size heat exchanger face area. | Follow a rule of thumb to keep the heat exchanger face velocity lower than 450 feet per minute (fpm). | Heat exchanger face area = (Volumetric flow rate)/(maximum face velocity) = 600/450 = 1.33 $ft^2$ |
| Ⓖ | Determine the aspect ratio, of the heat exchanger. | The heat exchanger will be sitting on top of a gas furnace. It should fit. | (2) 10" high x 16" long x 1.5" deep<br>Total face area = 2.22 $ft^2$ |
| Ⓗ | Select heat exchanger components such as tube shape, tube material, wall thickness, fin type, fin material, thickness, header, etc. | Get enough heat transfer area by extending tube surface area by lacing fins through tubes.<br>Heat exchanger produces high heat transfer, but with low pressure drop. | If we choose 3/8" copper tube outside diameter, 1" tube center-to-center distance, (10) tube per row, two rows.<br>0.0042" thick Al fins, 0.625" fin width, (12) fins per inch (FPI), (192) fins per row.<br>Total heat transfer area = 29.69 $ft^2$ |
| | | | The total heat transfer is about 18,000 Btu/hr, and the pressure drop is 0.12", which is higher than the maximum allowable value shown in Ⓒ.<br>If we choose noncircular tubes, a/b = 3.75, perimeter = 1.0425", 0.75 tube center-to-center distance, (14) tube per row, two rows.<br>0.0095" thick Al fins, 0.75" fin width, (12) fins per inch (FPI), (192) fins per row.<br>Total heat transfer area = 40.96 $ft^2$<br>The total heat transfer is about 18,000 Btu/hr. and the pressure |

Fig. 10

HEAT EXCHANGERS BASED ON NON-CIRCULAR TUBES WITH TUBE-ENDPLATE INTERFACE FOR JOINING TUBES OF DISPARATE CROSS-SECTIONS

BACKGROUND OF THE INVENTION

1. Field of the Invention

This invention relates to heating, ventilation, air conditioning and refrigeration ("HVAC/R") heat exchangers that reduce the resistance to airflow across coils.

2. Background Art

Many conventional heat exchangers include round tubes through which a refrigerant passes. Heat is exchanged between the refrigerant and air flowing around the outside of the tubes.

One major energy consumption consideration in HVAC/R systems is the power required to pump air through the heat exchanger. The energy required to overcome the flow resistance represents how well a heat exchanger is designed and structured. The losses in pressure are the result of the air path as it encounters tubes and airside fins. When comparing heat exchanger structures, friction factor as well as Nusselt number are usually obtained from wind tunnel tests and used to support coil design decisions. The most commonly used expression for coil pressure drop is that of Kays and London [1], which for flow normal to tube banks is:

$$\frac{\Delta P}{P_1} = \frac{G^2}{2g_c}\frac{v_1}{P_1}\left[(1+\sigma^2)\left(\frac{v_2}{v_1}-1\right)+f\left(\frac{A}{A_c}\right)\left(\frac{v_m}{v_1}\right)\right]$$

where:

$\Delta P$—Flow stream pressure drop $P_1$—Entrance pressure

G—Flow stream mass velocity $g_c$—Proportionality factor in Newton's second law $v_1$—Specific volume at entrance $v_2$—Specific volume at exit $$v_m = \frac{(v_1+v_2)}{2}$$

$\sigma$—Ratio of free flow area to frontal area f—Mean friction factor

A—Total heat transfer area $A_c$—Minimum free flow area.

Expressed alternatively:

Pressure drop=flow acceleration+core friction

The core friction portion of this relationship is made up of the entering air volume ($v_1$), mean specific volume, the total heat transfer area (A), the free flow area ($A_c$) and the core friction factor. The free flow area is determined by the total tube frontal face area. By flattening the tubes and presenting the sharper tube edge to incident air and increasing $A_c$, the airside pressure drop can be reduced.

For reference, a commercial air handler configuration is shown in FIG. 1. Depending on customer requirements, components for filtering, heating, cooling and controlling air humidity are combined to achieve the desired room conditions. The design in FIG. 1 has a final filter (e.g., a high efficiency particulate air-HEPA filter with 99.97% efficiency), a dehumidification coil, an energy recovery wheel, UV light emitters, and five sets of modulating dampers to control the percentage of outdoor air. Motor and fan assemblies permit the system to deliver the required airflow at the specified external pressure. These components consume energy.

The consequences of combining such components in the conventional HVAC/R system are an undesirable increase in resistance to the passage of air, the consequent pressure drop and subsequent increase in energy consumption.

Further, the management and control of indoor air quality (IAQ) is a topic of high priority in the global HVAC industry. At the end of last century, several serious diseases were related to some buildings. Researchers discovered that microorganisms such as mold, bacteria, yeasts, dust mites and virus grew and spread in homes, offices, and commercial buildings through air conditioners. They observed that the recycled air inside a building may cause a Sick Building Syndrome. Uncontrolled humidity (either too high or too low) supplied a perfect environment for microorganisms.

Accordingly, in 2001, the first industrial standard, ASHRAE 62-2001, *"Ventiliation for Acceptable Indoor Air Quality"*, was released as a guideline for manufacturers, builders, and HVAC contractors. One consequence of meeting those standards is an increase in overall pressure drop due to additional filtration and humidification control devices.

Another factor in the HVAC industry is that the ozone-depleting refrigerant R-22, now used in most residential air conditioning systems, will be phased out by 2010. Similar programs for phasing out CFC and HCFC refrigerants in refrigeration and air conditioning systems are being implemented in Europe. Alternate refrigerants such as R-410A have been developed to replace the R-22 refrigerant. Due to higher operating pressures, R-410A systems require improved heat exchanger tubing and components.

Among the art identified in connection with a search undertaken before filing this application are the following U.S. references: U.S. Pat. Nos. 4,168,744; 4,206,806; 4,766,953; 5,123,482; 5,348,082; 5,425,414; 5,538,079; 5,604,982; 5,901,784; 6,003,592; 6,021,846; 6,044,554; 6,378,204; DE 3423746 C2; DE 3538492 A1; DE 4109127 A1; and EP 0272766 B1.

SUMMARY OF THE INVENTION

Broadly stated, the invention disclosed and claimed deploys non-circular tubes and other components that improve the performance of HVAC/R systems.

BRIEF DESCRIPTION OF THE DRAWINGS

FIG. 10 is a process flow chart that depicts the main steps involved in practicing the art of heat exchanger design using heat exchangers that are constructed in accordance with the present invention;

DETAILED DESCRIPTION OF THE PREFERRED EMBODIMENT(S)

Non-Circular Tubes

Figure 1:
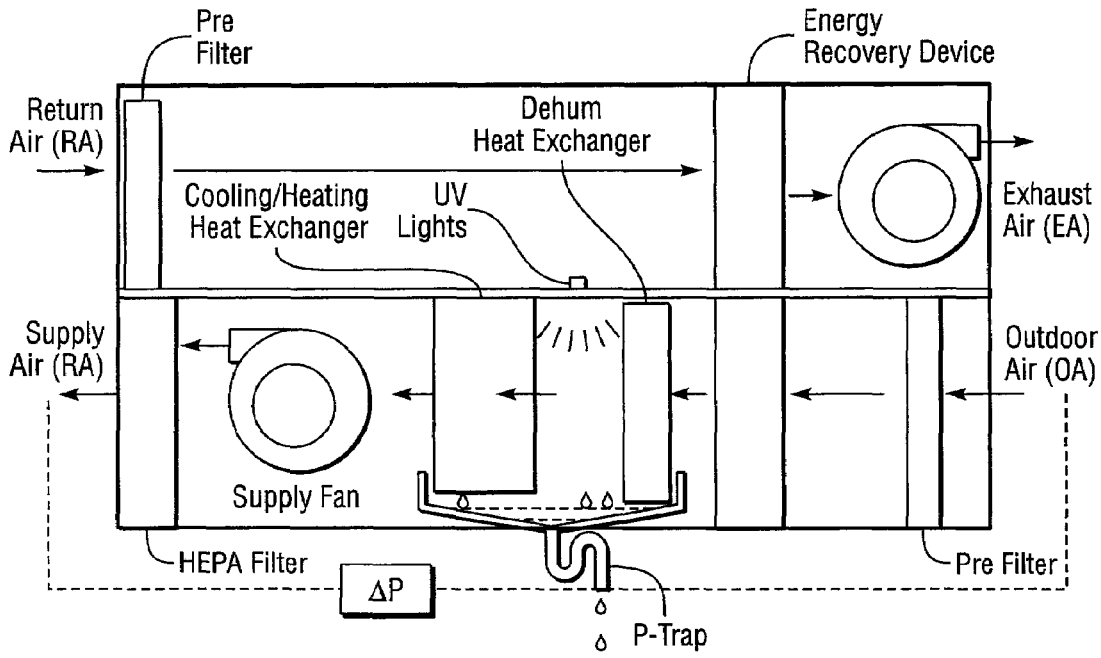
FIG. 1 depicts the current technology for HVAC systems and components, which resist the passage of air through the system and thus contribute to unwanted pressure drop.

FIG. 1 depicts an overall environment in which the invention may be situated. This figure illustrates, as noted earlier, a conventional HVAC system. It may include components for filtering, heating, cooling, and controlling air humidity. These components are combined to achieve the desired environmental conditions. Additionally, a dehumidification coil, an energy recovery wheel, UV light emitters and modulating dampers may combine to obstruct further the passage of air flowing through the heat exchanger. To improve heat transfer efficiency, motor and fan assemblies may permit the system to develop the required air flow at a specified external pressure.

Figure 2:
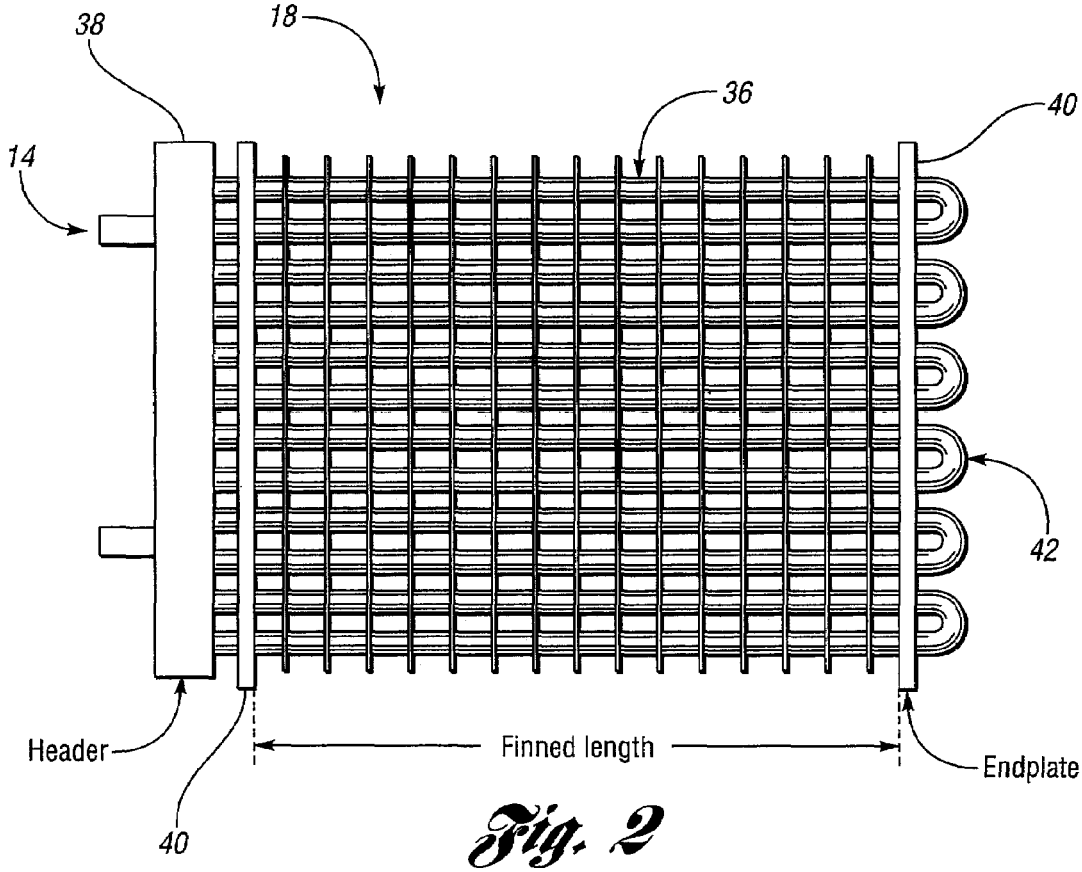
Fig. 2 (PRIOR ART)
FIG. 2 is a typical structure of a conventional fin-and-tube heat exchanger with a header and round return bends.

FIG. 2 illustrates a prior art heat exchanger which has round tubes 36 that are used in the central body of the core 18. A heat exchange fluid 14 enters the heat exchanger 10 at the header 38. The header 38 serves as a reservoir or interim storage location for heat exchange fluid as it enters, passes through, and leaves the core 18 of the heat exchanger 10. The round tubes 36 are supported between endplates 40 which also serve to space the tubes 36. Curved return bends 42 serve to redirect heat exchange fluid.

Figure 3:
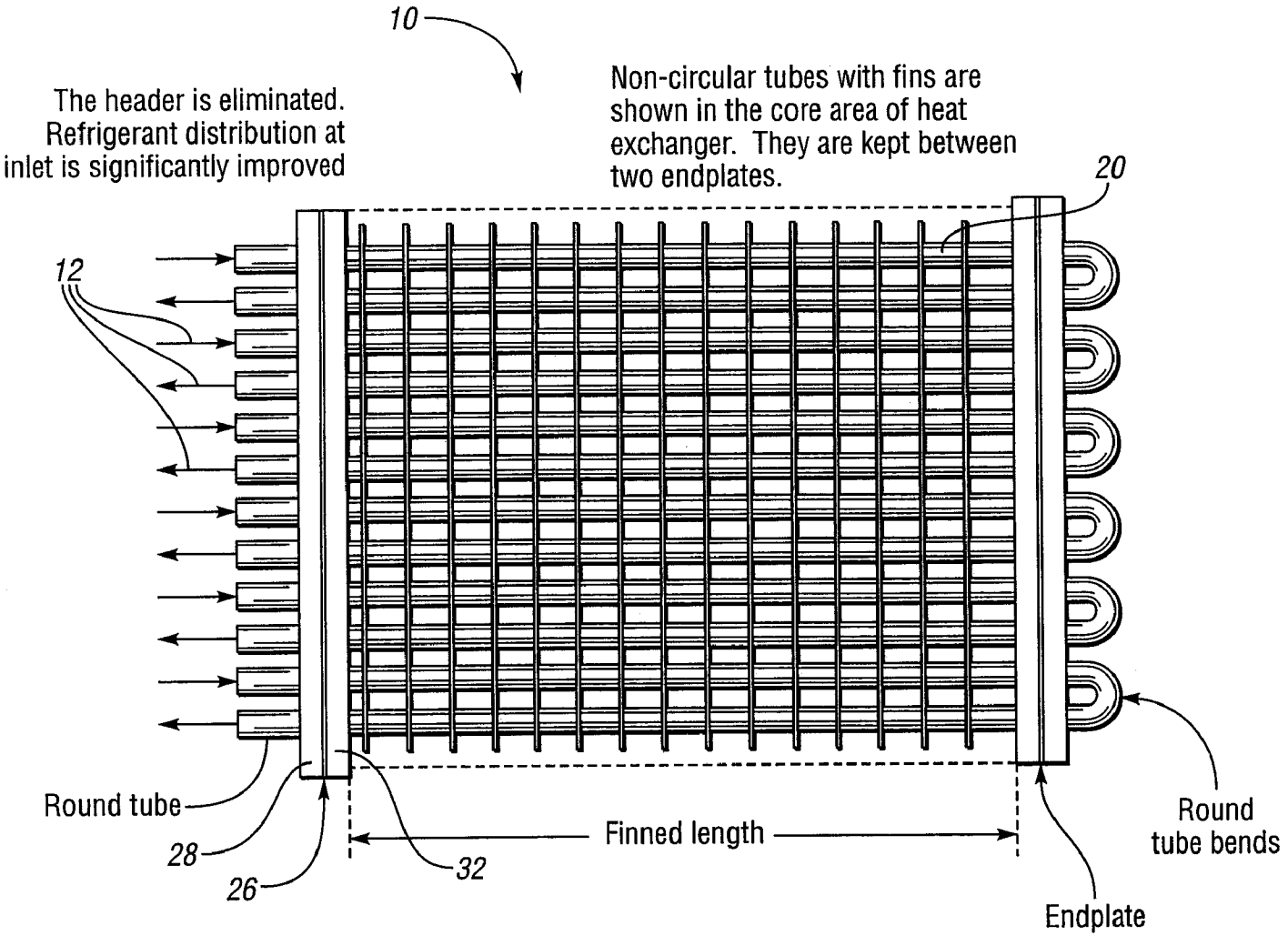
FIG. 3 is a schematic of a non-circular tube heat exchanger with inventive endplates.

FIG. 3 depicts an illustrative embodiment of the invention. The header 38 is eliminated. Refrigerant distribution at the inlet (left hand side) is significantly improved because in the embodiment shown, fluid enters the heat exchanger at multiple locations. Thus, the heat exchanger 10 has at least one inlet tube 12 that ducts a heat exchange fluid 14 into the core 18. At least one of the inlet tubes 12 is characterized by a first cross-sectional profile 16, which in many embodiments is round (FIG. 7A(a)). As used herein, the term "first cross-sectional profile" refers to the cross-section of inlet tubes 12; the term "second cross-sectional profile" refers to the cross-section of non-circular or oval tubes found in the core 18 of the heat exchanger 10. The first and second cross sectional profiles are characterized by shapes and sizes that may be the same or different.

Figure 7A:
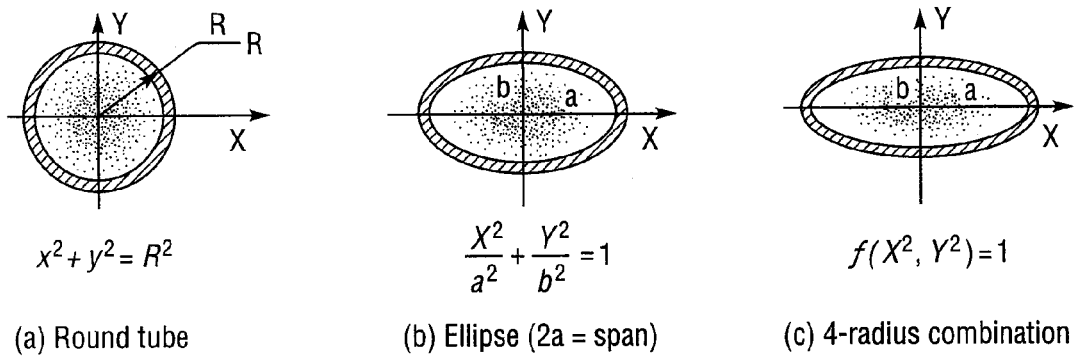
FIG. 7A (a-c) are cross sectional views of tubes: (a) round; (b) elliptical; and (c) a 4-radius combination.

Consider the fluid flow as it enters the upper left hand inlet tube 12. It moves from left to right across the page in FIG. 3. One example of the first cross-sectional profile is a round cross-section (as depicted in FIG. 7A(a)). The core 18 is in fluid communication with the at least one inlet tube 12. The core has multiple rows of core tubes 20 that duct the fluid. The core tubes 20 are characterized by a second cross-sectional profile 22. Two examples are depicted in FIGS. 7A:(b, oval) and (c, 4-radius). The first cross-sectional profile 16 differs from the second cross-sectional profile 24.

A first endplate assembly 26 receives the at least one inlet tube 12. The first endplate assembly 26 has a first section 28 (FIGS. 5, 6A, 6B) that defines an inlet orifice 30 that is sized to sealingly engage the first cross-sectional profile 16. Mating with the first section 28 is a second section 32 of the first endplate assembly 26. The second section 32 defines an outlet orifice 34 that is sized to sealingly engage the core tubes 20 and corresponding second cross-sectional profiles 24. The first and second sections cooperate to provide a sealing engagement and continuity of fluid flow therebetween.

Thus, a streamlined tube interface and profile (FIGS. 2-7) have been developed to replace the circular tubes that are customarily deployed in conventional HVAC/R systems (FIG. 1). FIG. 7A(a) shows conventional round tube geometry; while FIGS. 7A(a-b) show two alternative embodiments of non-circular (collectively "oval") tube shapes: an ellipse and a multiple (e.g., 4- or more) radii: combination. Also included in the term "oval" are ovate, oblong ovate, racetrack-like figures, and kidney-shaped figures. From an aerodynamic point of view, other things being equal, the pressure drop around the tubes shown in FIGS. 7A(a-b) is smaller than for a circular tube. Computational Fluid Dynamics (CFD) analysis of flow over the tube profiles from FIGS. 7A(a-b) was conducted and the results (FIG. 7B) show that a reduction in pressure drop was obtained for non-circular tube shapes.

It is therefore reasonable to expect that a heat exchanger constructed from non-circular tubes would have a lower pressure drop in service and give the air handler in FIG. 1 some extra static pressure that can be deployed to overcome the resistance from dehumidification coils and other impediments downstream of the airflow.

In some embodiments, the second profile can be characterized by a major axis. In such embodiments, at least some of the core tube may be tilted in relation to the air that passes through the core. In such cases, the angle of inclination of the major axis to a main stream of the air flowing through the heat exchanger can be characterized by an angle of attack.

EXAMPLES

By comparison of oval to round tubes, the disclosed invention reduces airside pressure by 20 to 50% while maintaining competitive heat transfer rates. Also, the unique tube to endplate interface assembly 26 simplifies the joinder of circular to non-circular heat exchanger tubes.

Preferred oval tube shape, spacing and air side fin combinations have been identified to meet the operating pressure demands of modern refrigerants while maintaining heat exchanger integrity and reliability. Wind tunnel test data, finite element analysis and computational fluid dynamics (CFD) simulation data have been used to validate the invention.

Figure 8:
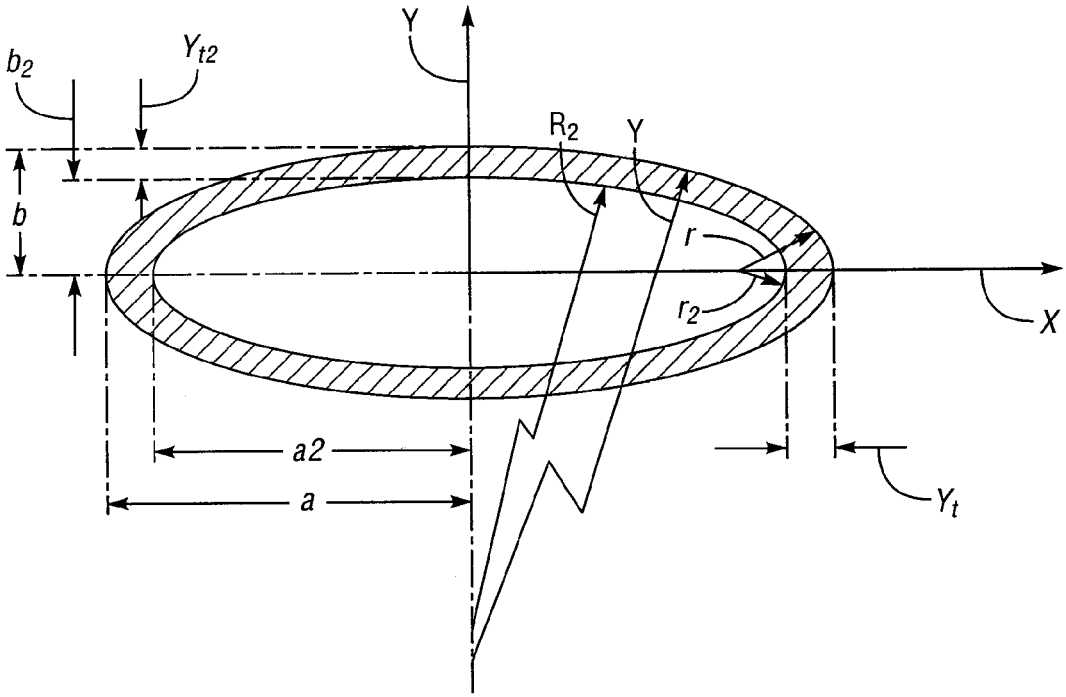
FIG. 8 illustrates further detail of a 4-radius combination tube of the type depicted in FIG. 7A(c)

A detailed CFD investigation DOE (design of experiment in Six Sigma) was carried out and the optimal values for a and b were identified for the 4-radius combination (see FIG. 7A(c)). The criteria for tube performance were based on airside pressure drop and heat transfer under various airflow conditions. One optimal tube design is discussed below. It has the same perimeter as a ⅜" OD round tube. FIG. 8 shows the characterizing variables of a 4-radius combination non-circular tube.

Figure 9:
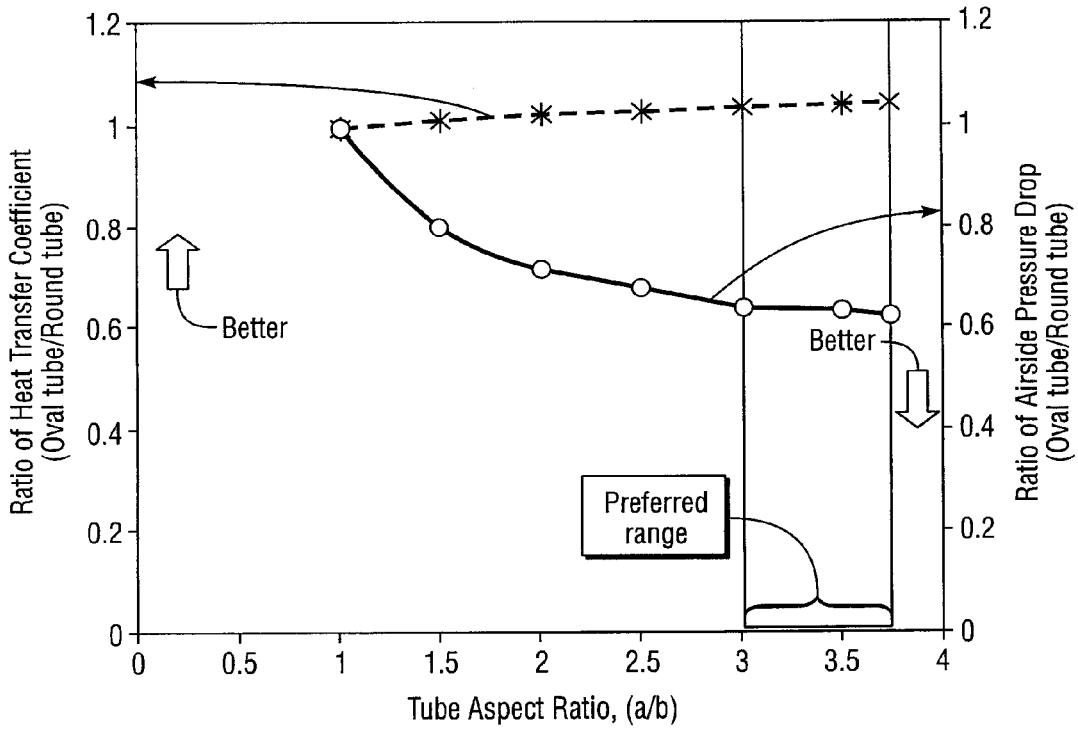
FIG. 9 is a graph that illustrates the tube performance (calculated by CFD) which shows how heat transfer changes with tube aspect ratio.

FIG. 9 is a graph of tube aspect ratio (a÷b—see, FIG. 8) against heat transfer and airside pressure drop. CFD analysis identified an optimal tube aspect ratio of between 3 and 3.75 for a 4-radius combination tube, depending on how fins are bonded to the core tubes. For brazing operations, a large aspect ratio is preferred. If a mechanical expansion is used to bond the fin and tubes, a small aspect ratio is preferred because it is easier to insert expansion beads.

Tube Spacing

Figure 11:
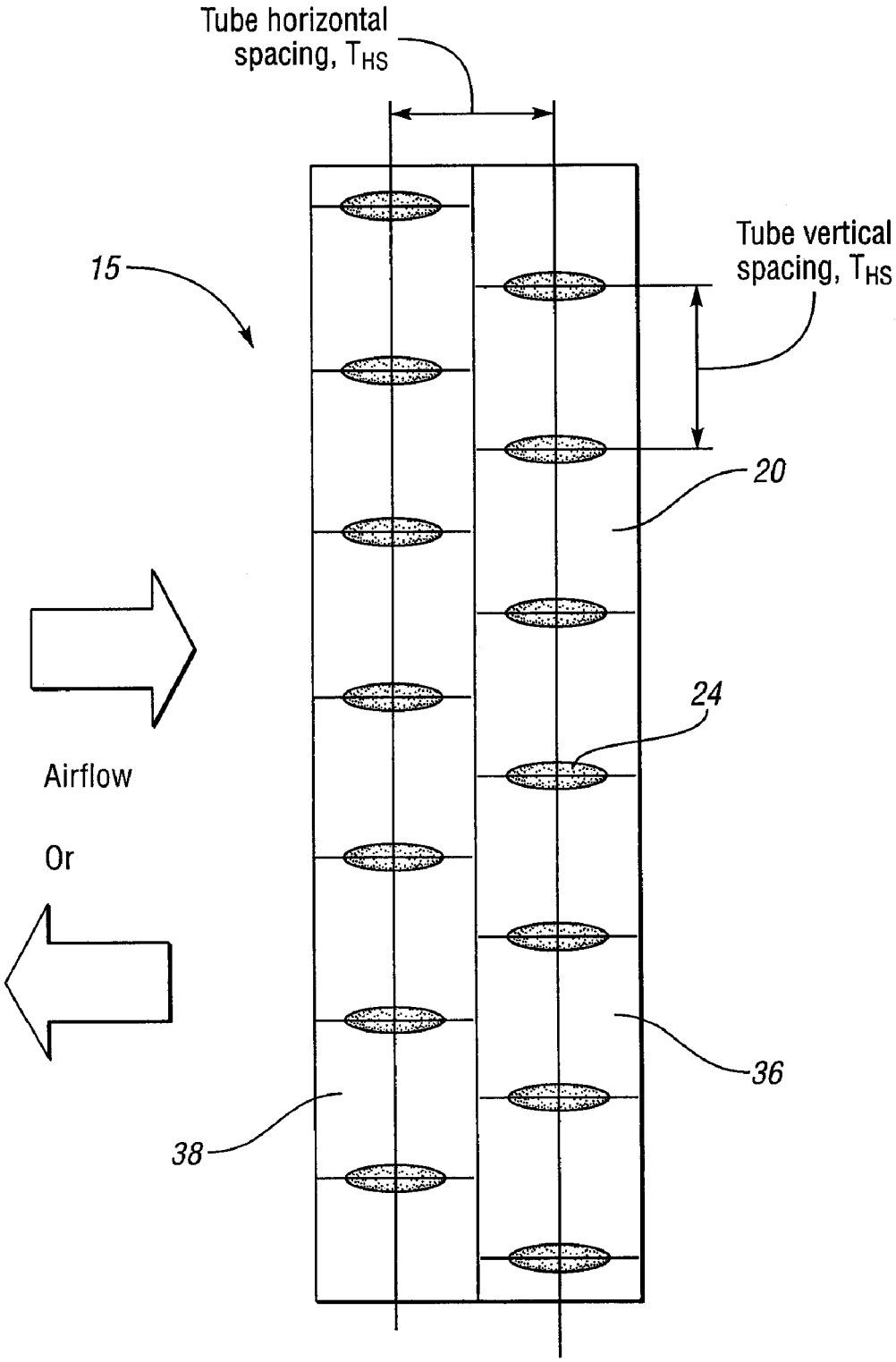
FIG. 11 is a side view of a heat-exchanger that defines tube horizontal and vertical spacing for a two-row coil of the type depicted in FIGS. 4-5.

A flattened round tube offers more free flow area if either ($T_{hs}$, FIG. 11) small radiused side is presented to incident air. As a result, the tube horizontal ($T_{hs}$) and vertical spacing ($T_{vs}$) need to be optimized. For a 4-radius combination tube with a=23.62", and b=0.063", the preferred tube horizontal ($T_{hs}$) and vertical ($T_{vs}$) spacing are 0.75" and 0.75", respectively, as shown in FIG. 11. In general, it is preferable to shorten the tube vertical spacing and lengthen the tube horizontal spacing.

Flat and Louvered Fins

Figure 12A:
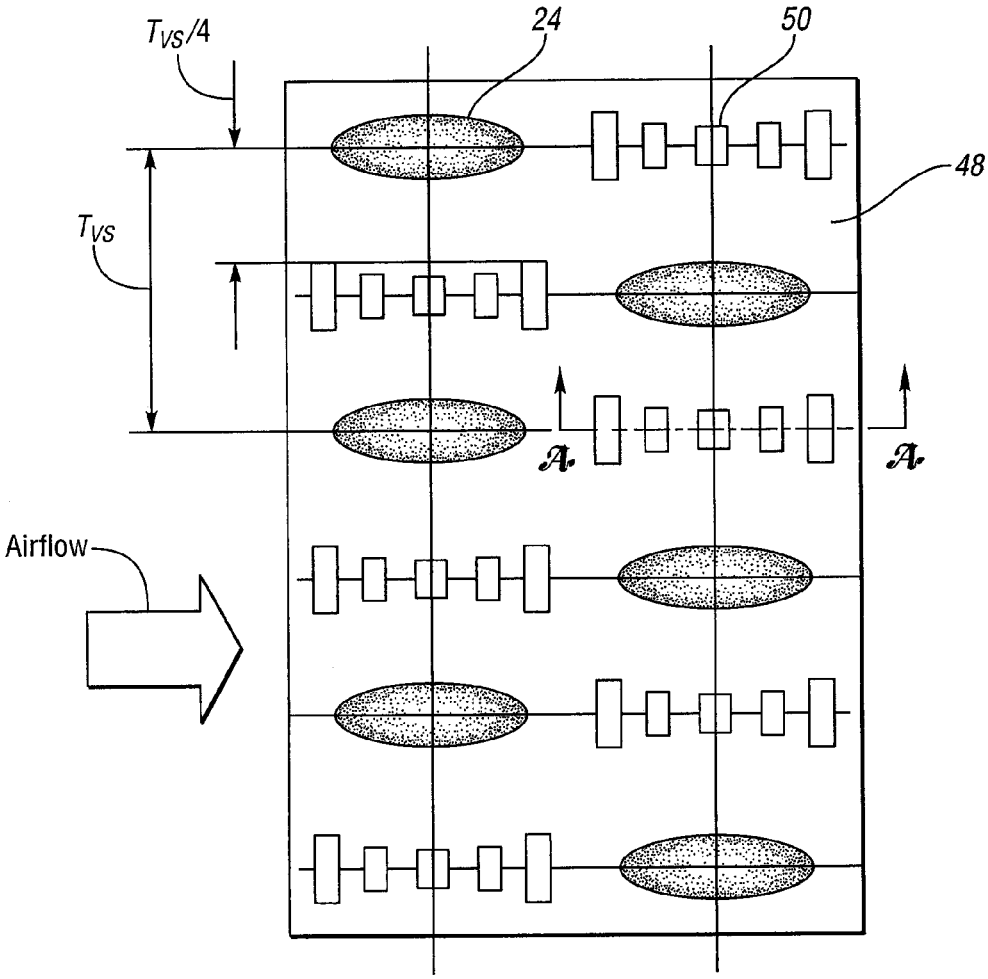
FIG. 12A is a side view of a louver fin design for oval tubes in a horizontal orientation.
Figure 12B:
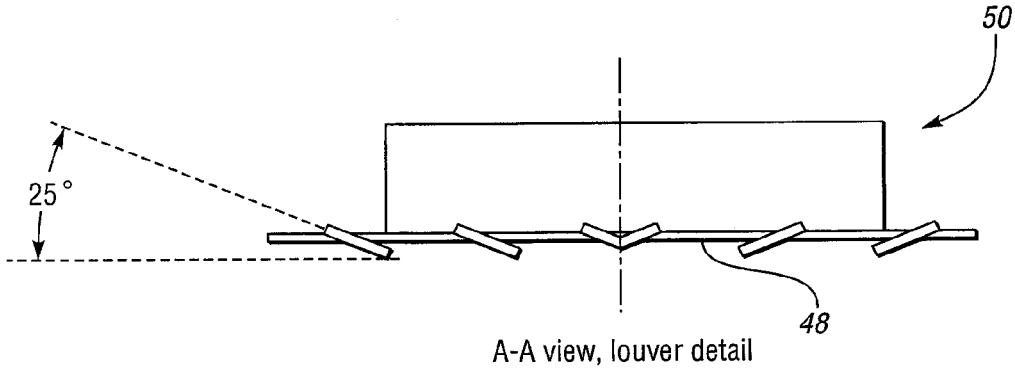
FIG. 12B is a cross-sectional view taken along the line A-A of FIG. 12A, illustrating detail of the louver structure.

Two fin designs were developed for a 4-radius combination tube, as shown in FIG. 12. Preferably, most of the louvers follow the contours of oval tubes. For example, a shorter louver length is juxtaposed with the fattest vertical section of the horizontal tube. To allow condensate to escape, a preferred louver angle is about 25°.

Figure 13:
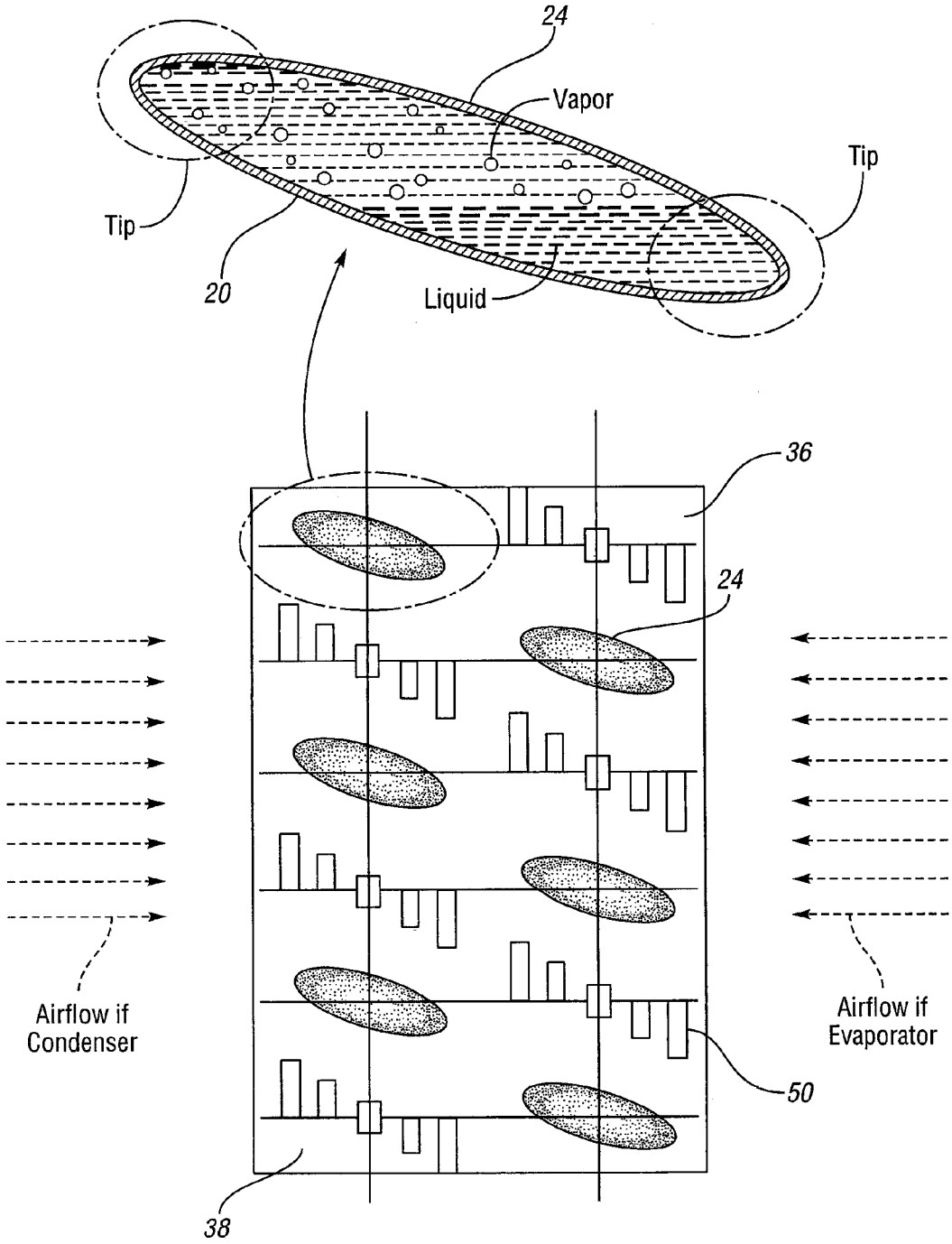
FIG. 13 is a louver fin design for oval tubes in a tilted orientation for condenser and evaporator applications with an enlarged view of a tube cross-section having a two-phase refrigerant flowing inside a tilted oval tube.

FIG. 13 shows alternative tube-louver configurations for condenser and evaporators that deploy tilted oval tubes. When an oval tube is tilted in relation to incident air, (FIG. 13), there is an angle between the airflow stream and the long axis of an oval tube cross-section. When two-phase refrigerant flows inside oval tubes, the liquid phase will favor the lower region of the tube, and vapor will rise to the upper region, as shown in the enlarged portion of FIG. 13. The rate of heat transfer at the tips is higher than at the rest of the tube surface. If airflow attacks the left tip, it helps vapor condense, which is suitable for a condenser. On the other hand, if airflow attacks the right lower tip first, it helps liquid evaporate. On the outside of oval tubes, tilted oval tubes help drain condensate from tube surface.

Endplates

FIG. 2 shows a conventional round tube and fin heat exchanger. Two endplates are made from a material that holds together core tubes and a fin stack, provides a spacer and offers structural integrity. Round tubes in a generally hairpin shape protrude from and penetrate the endplates.

In microchannel heat exchangers, one header (on the left in FIG. 2) supplies refrigerant to fluid circuits. The function of a right hand header is similar to return bends in round tube heat exchangers. In an evaporator as shown in FIG. 2, the refrigerant in a two-phase state flows into the left header. Because of differences in density and viscosity between vapor and liquid, the refrigerant experiences a phase separation soon after it enters the header. The separation causes most liquid to flow through the lower tubes and vapor to flow through the upper tubes.

In the disclosed invention (FIG. 3), an endplate assembly 26 is introduced at either or both end edges of the core 20 to ameliorate fluid mal-distribution. The tube shape transition from round to non-circular is complete within two sections 28, 32 of an endplate assembly 26. All non-circular tubes 20 are positioned in the core area of the heat exchanger and are supported by fins. Therefore, heat exchangers with non-circular tubes can withstand high pressures. The invention significantly simplifies header and endplate designs.

Figure 6A:
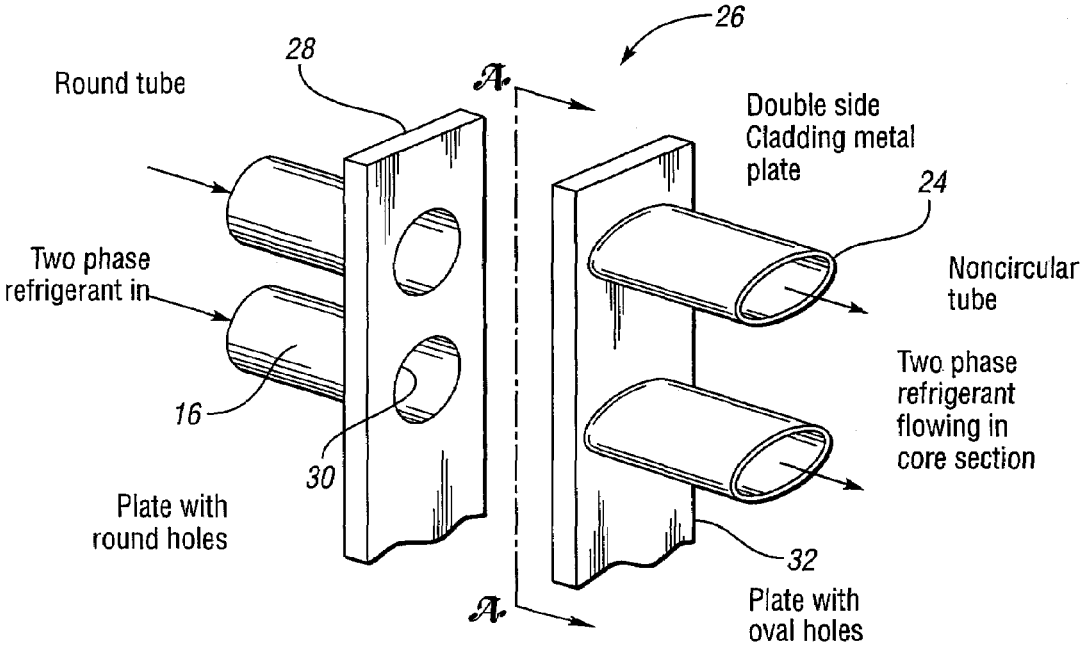
FIG. 6A is an exploded view of one embodiment of the inventive two-piece endplate for non-circular tube evaporators.
Figure 7B:
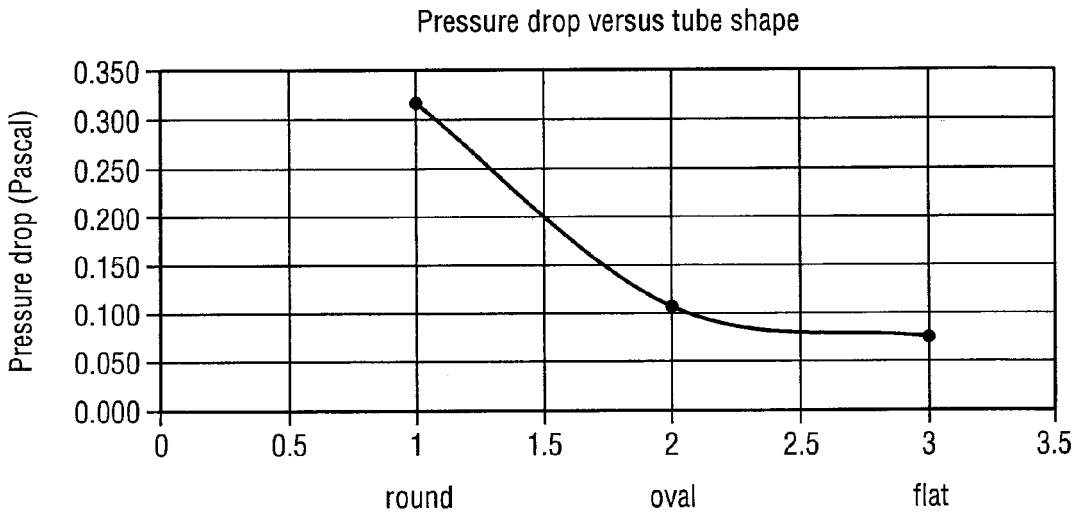
FIG. 7B is a graph showing pressure drop for various tube shapes derived from CFD simulations.

FIG. 6A shows an exploded view of an endplate assembly 26. It has two sections or plates 28, 32, preferably with double sided cladding material. One plate 28 has round holes and the other 32 has non-circular holes. In the assembly process, round tubes are inserted into the plate 26 with round holes, and non-circular tubes are inserted into the plate 32 with non-circular holes. These two plates may be brazed together, for example, by using a NOCOLOK® process.

If the endplate assembly 26 is on the supply side (left side in FIG. 3), a refrigerant mixture of liquid and vapor flows from round tubes 12 through the endplate assembly 26 into the non-circular tubes 20 located in the core 18.

Figure 6B:
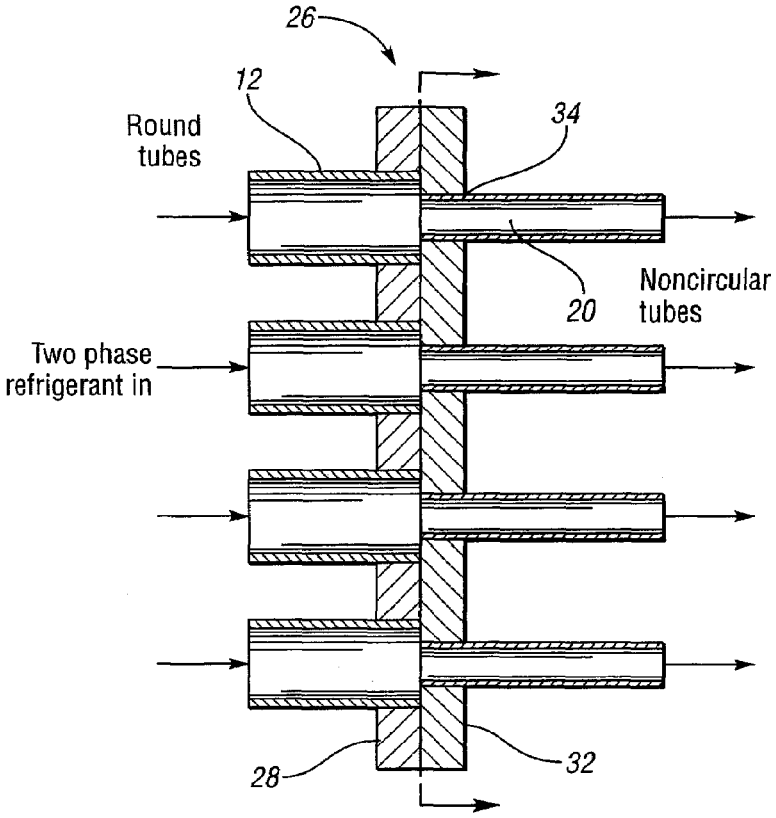
FIG. 6B is a cross sectional view of the inventive endplate, taken along the line A-A of FIG. 6A.

FIG. 6B further illustrates the transition from round to non-circular tubes within an endplate assembly 26. There are various alternative embodiments for round and oval tubes of different sizes. Three examples are shown in FIG. 7. The span or major axis (2*a*) of an oval tube can be larger than or equal to the minor axis (2*b*). Preferably, the span of a non-circular tube (2*a*, FIG. 7A (c)) equals the round tube diameter 2 R (FIG. 7A (a)).

Because an oval tube can be tilted as shown in FIG. 13, the orientation of the oval tube at the endplate can be at different angles.

Figure 4:
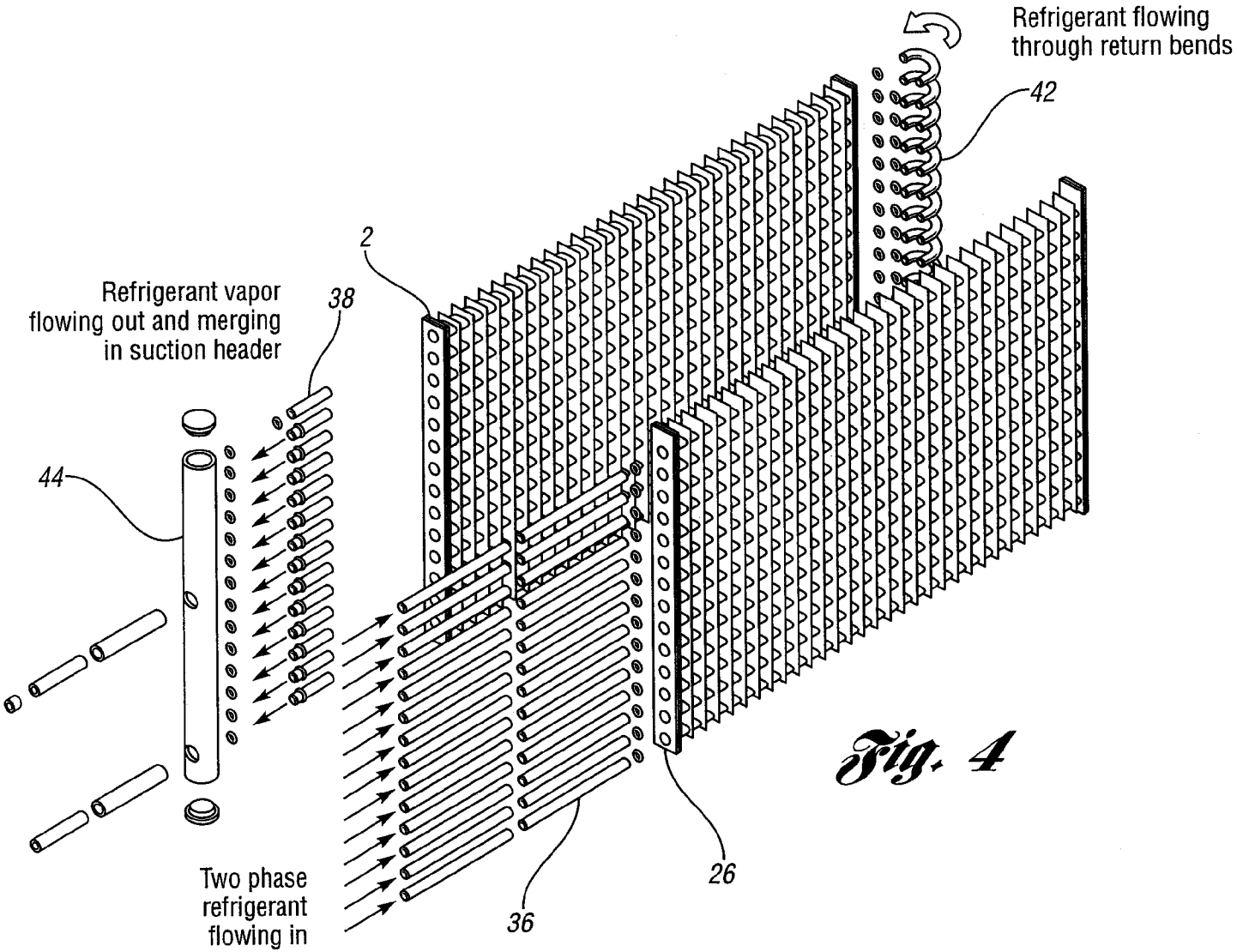
FIG. 4 is an exploded view of a heat exchanger according to the present invention that includes a two-row coil.
Figure 5:
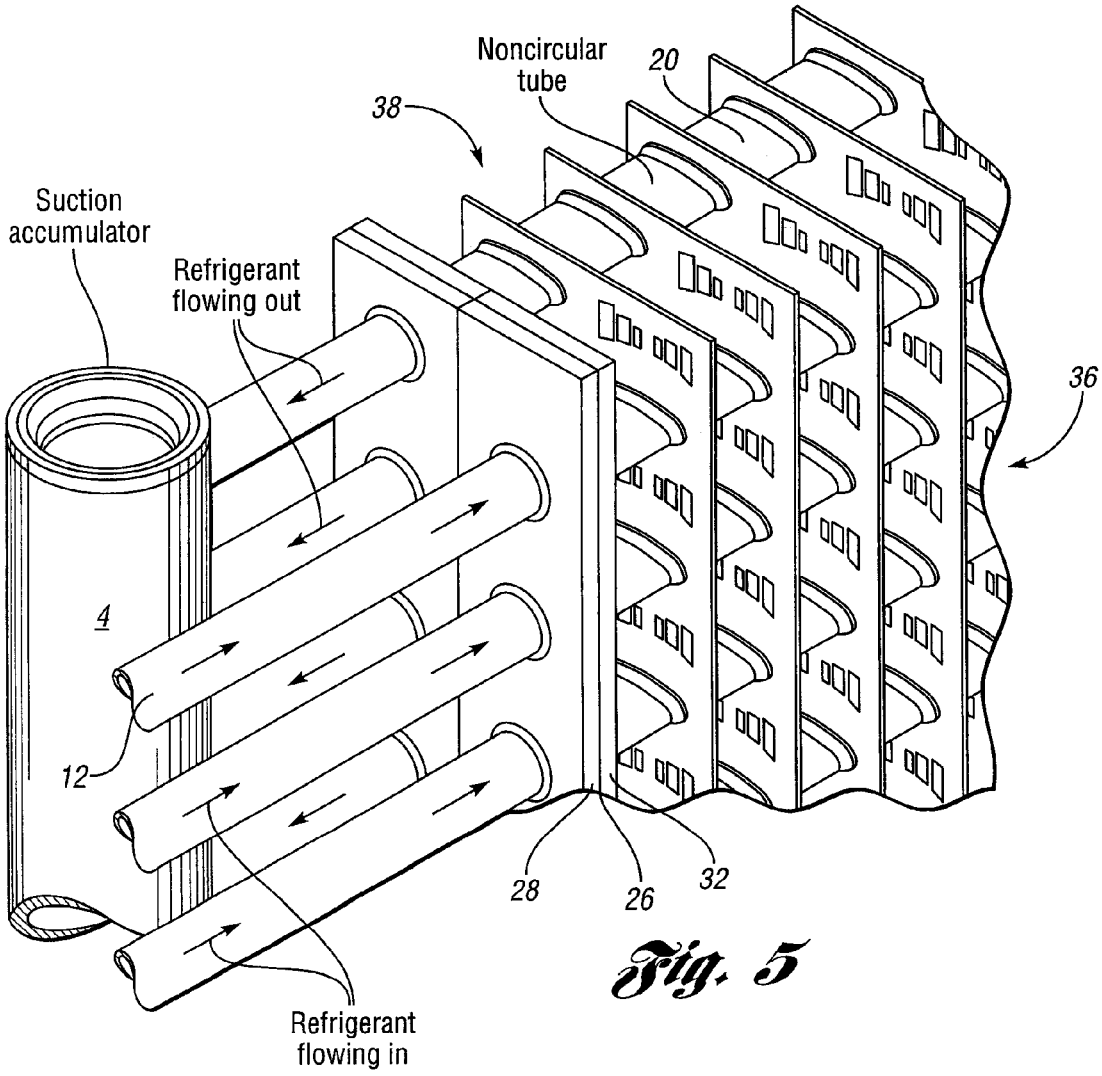
FIG. 5 is an enlarged view of a portion of one embodiment of a heat exchanger that includes the present invention, including round tubes, oval tubes, fins with louvers, and a transition member that sealingly ducts fluid flow from a round tube to a non-circular tube.

FIGS. 4-5 are perspective views of one embodiment of the invention. FIG. 4 depicts an embodiment of a heat exchanger 10 with two arrays 36, 38 of non-circular tubes that are found in the core of the heat exchanger. Fluid flows into the front array 36 (as depicted). The fluid then traverses the fluid redirecting conduits that link the first and second arrays (at the right hand side of FIG. 4). Then, following a reversal of direction, refrigerant fluid traverses the second array and then passes through an outlet header 44 and outwardly through outlet tubes. Emergent fluid flow may be quickened by suction means (not shown) that are in communication with the outlet header 44. From the outlet header, heat exchanger fluid exits via one or more outlet conduits.

Turning now to FIG. 5, the tubes of the lower left of the heat exchanger are inlet tubes 12. They fluidly communicate with non-circular tubes 20 that are disposed within the core of the heat exchanger. Together, the inlet circular and non-circular tubes comprise the first array 36 of tubes. The second array 38 of tubes is illustrated in a position that is behind the first array. The second array provides a means for ducting the heat exchange fluid into an outlet manifold 46.

Figure 14A:
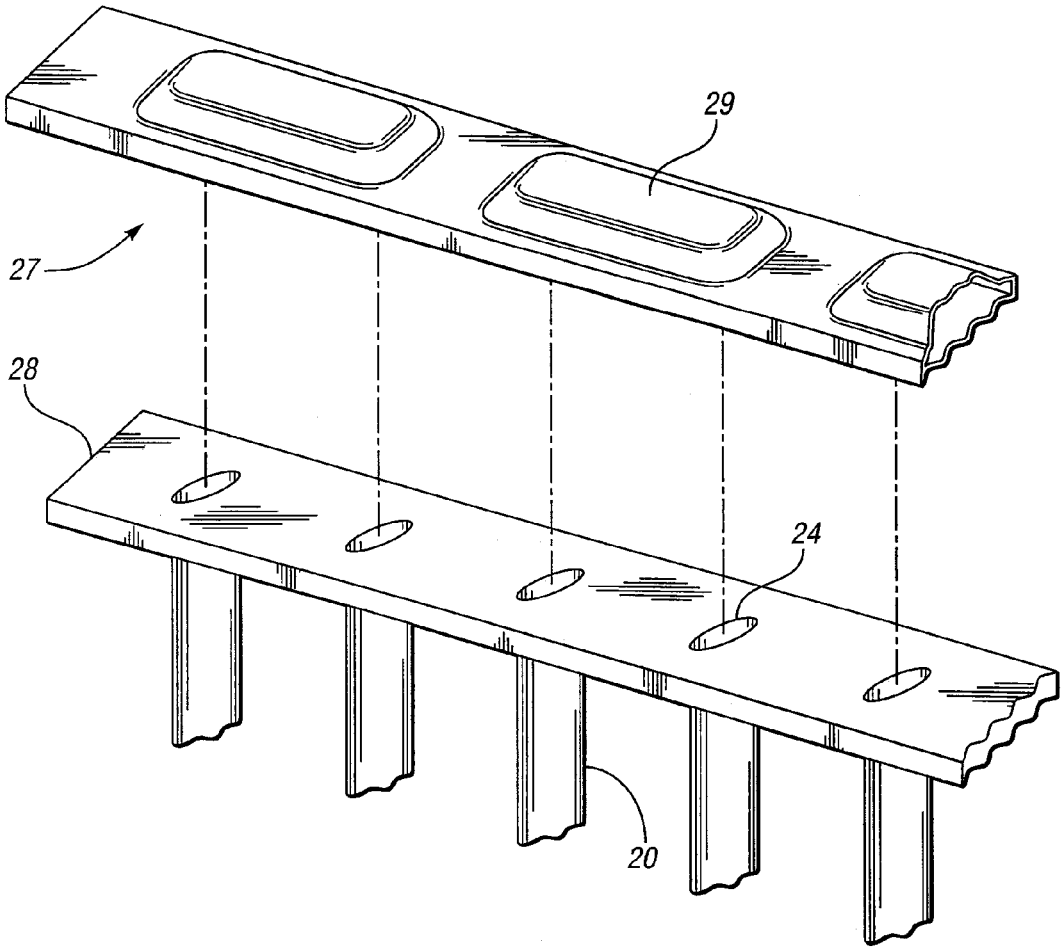
FIG. 14A is an exploded view of a flow rerouting conduit defined in a single row header assembly; as an alternative to the round return bends depicted in FIG. 4.
Figure 14B:
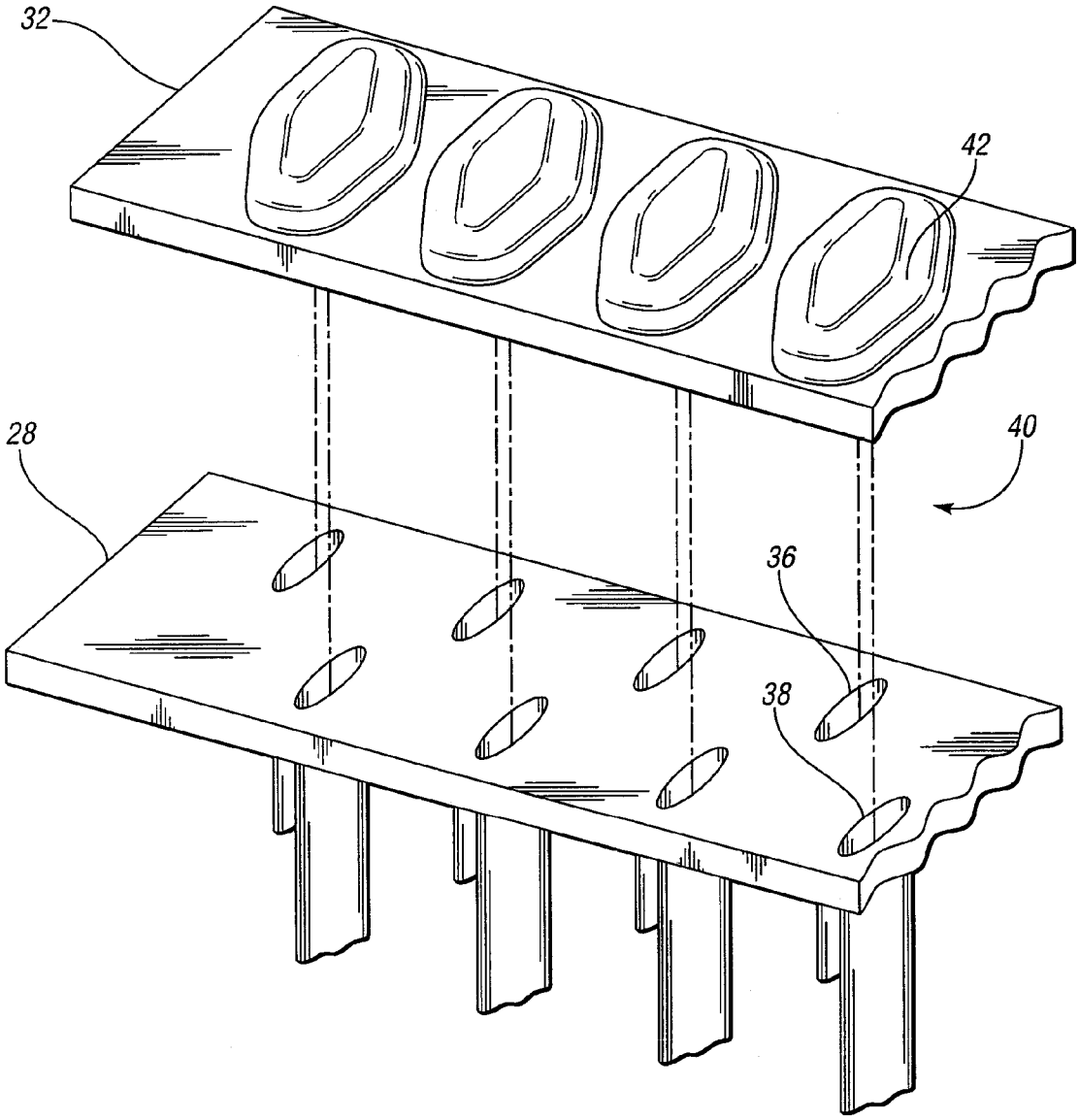
FIG. 14B illustrates a two-row header that includes a preformed outer plate.

In FIGS. 14A-B, there are depicted alternate embodiments of a second end plate assembly 27. That assembly comprises a first section 28 that has orifices that receive non-circular tubes. The second section defines an arcuate trough or conduit 29 that serves to redirect fluid flow sealingly from one non-circular tube to another.

As used herein, the terms "first section" and "second section" are not limited to separate physical structures which are bonded or brazed together. Such terminology is meant to embrace a structure wherein an endplate assembly may be formed as a unitary structure that defines orifices or troughs or conduits that are appropriate to the application. If desired, the arcuate trough may include a return bend that has a diameter that varies along its length.

Experimental observations confirm that the second endplate assembly was fluid tight after processing in a NOCOLOK® furnace. The cladding material, driven by capillary forces sealed all gaps (see FIG. 14.) There was no leak at endplates 26, 27. The heat exchanger was pressurized with 55 psia, which is the saturated vapor pressure for R-134a at 40° F.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A heat exchanger having at least one inlet tube that ducts a heat exchange fluid, at least some of the inlet tubes being characterized by a first cross-sectional profile;

a core in fluid communication with the at least one inlet tube, the core having one or more rows of core tubes that also duct the fluid, at least some of the core tubes being characterized by a second cross-sectional profile, wherein the first differs from the second cross-sectional profile;

a first endplate assembly positioned between the at least one inlet tube and the core, the first endplate assembly having an inlet plate and a core plate, an inlet orifice in the inlet plate that is sized to sealingly engage the first cross-sectional profile; and an outlet orifice in the core plate that is sized to sealingly engage the second cross-sectional profile, the inlet and core plates cooperating to provide a sealing engagement therebetween along substantially the entire length of the plates, each of the at least one inlet tubes extending outside the first endplate assembly.

2. The heat exchanger of claim 1 wherein the one or more rows of core tubes comprise two arrays of core tubes, the two arrays comprising a first array that receives inlet fluid and feeds the fluid to a second array, the heat exchanger also comprising flow rerouting conduits at one edge of the core that sealingly communicate between the first and second rows.

3. The heat exchanger of claim 1 wherein the first endplate assembly includes two faces on each of the plates, each face having a cladding material thereupon.

4. The heat exchanger of claim 1 wherein the second cross-sectional profile includes an ellipse.

5. The heat exchanger of claim 1 wherein the second cross-sectional profile includes a 4-radius combination.

6. The heat exchanger of claim 2 wherein the vertical spacing between adjacent rows of tubes in the first array is a dimension ($T_{vs}$) and the two arrays are spaced horizontally by a tube spacing ($T_{hs}$), where ($T_{vs}$) =($T_{hs}$).

7. The heat exchanger of claim 6 wherein the heat exchanger is provided with fins through which the core tubes pass, at least some of the fins being provided with louvers that extend therefrom into air that flows through the heat exchanger.

8. The heat exchanger of claim 1 further comprising a second endplate assembly, the second endplate assembly having a first section that defines an orifice that is sized to sealingly engage the second cross-sectional profile; and a second section that defines a fluid redirecting conduit, the first and second sections cooperating to provide a sealing engagement therebetween.

9. The heat exchanger of claim 1 wherein at least some of the tubes are formed from a material selected from the group consisting of aluminum, copper, clad metals, stainless steel, other metals, alloys thereof, non-metallic materials, and mixtures thereof.

10. The heat exchanger of claim 5 wherein a tube aspect ratio is between 3 and 3.75.

11. The heat exchanger of claim 7 wherein the louvers are spaced apart from a tube by distance (D), where (D) is approximately ($T_{vs}$)/4.

12. The heat exchanger of claim 7 wherein at least some of the louvers follow at least some contours of the core tubes.

13. The heat exchanger of claim 12 wherein an average inclination of a louver to a plane of a fin from which the louver extends is about 25°.

14. The heat exchanger of claim 1 wherein the second cross-sectional profile is characterized by a span and the first cross-sectional profile is characterized by an average diameter, the span of the second profile approximately equaling the average diameter of the first profile.

15. The heat exchanger of claim 1 wherein the second cross-sectional profile is characterized by a major axis, the major axis being oriented at an angle of attack in relation to incident air.

16. The heat exchanger of claim 8 wherein the fluid redirecting conduit has a diameter that varies along at least some of the length of the conduit.

* * * * *